US012584390B2

(12) United States Patent
Dolynchuk et al.

(10) Patent No.: US 12,584,390 B2
(45) Date of Patent: Mar. 24, 2026

(54) ANTI-ROTATION DEVICE FOR A ROD ROTATOR OF A RECIPROCATING ROD PUMPING SYSTEM

(71) Applicant: ChampionX LLC, Sugar Land, TX (US)

(72) Inventors: Devon Dolynchuk, Edmonton (CA); Doug Dupont, Edmonton (CA); Reza Eghtesad, Jenks, OK (US); Daniel Provencal, Sherwood Park (CA)

( * ) Notice: Subject to any disclaimer, the term of this patent is extended or adjusted under 35 U.S.C. 154(b) by 0 days.

(21) Appl. No.: 18/918,262

(22) Filed: Oct. 17, 2024

(65) Prior Publication Data

US 2025/0129694 A1 Apr. 24, 2025

Related U.S. Application Data

(60) Provisional application No. 63/591,399, filed on Oct. 18, 2023.

(51) Int. Cl.
*E21B 43/12* (2006.01)
*E21B 17/10* (2006.01)
*F04B 47/02* (2006.01)

(52) U.S. Cl.
CPC ..... *E21B 43/127* (2013.01); *E21B 17/1071* (2013.01); *E21B 17/1078* (2013.01); *F04B 47/026* (2013.01)

(58) Field of Classification Search
CPC ..... E21B 43/126; E21B 43/127; E21B 17/10; E21B 17/1071; E21B 17/1078;
(Continued)

(56) References Cited

U.S. PATENT DOCUMENTS 4,637,459 A 1/1987 Roussel
9,541,073 B2 1/2017 Rappenecker et al.
(Continued)

FOREIGN PATENT DOCUMENTS

CN 212317953 U 1/2021

OTHER PUBLICATIONS

Weatherford, Intelligent Rod Rotator, https://www.weatherford.com/documents/brochure/products-and-services/production-optimization/intelligent-rod-rotator/, 2013, 8 pages.
(Continued)

*Primary Examiner* — Loren C Edwards
(74) *Attorney, Agent, or Firm* — Scheef & Stone, L.L.P.; Keith C. Rawlins, Esq.

(57) ABSTRACT

Systems and methods are disclosed that provide a dual-arm anti-rotation device for a rod rotator of a bridle assembly, operably coupled to a reciprocating pumping system. The anti-rotation device includes an arcuate main body portion having, a first laterally extending arm extending from the arcuate main body portion, and a second laterally extending arm extending in an opposing direction from the arcuate main body portion. The first laterally extending arm is disposed on an inner side of a respective left-side bridle cable of the pumping system, and the second laterally extending arm is disposed on an outer side of a respective right side bridle cable of the pumping system to balance forces acting on the rod rotator force, such that no lateral or side load is imparted onto the rod rotator, during operation of the pumping system.

14 Claims, 7 Drawing Sheets

(58) Field of Classification Search
CPC ..... F04B 47/02; F04B 47/022; F04B 47/026; F04B 19/22; F04B 53/14
See application file for complete search history.

(56) References Cited

U.S. PATENT DOCUMENTS

| | | | |
|---|---|---|---|
| 10,047,739 | B2 | 8/2018 | Yin |
| 2011/0185825 | A1 | 8/2011 | Mackie |
| 2015/0000930 | A1 | 1/2015 | Haarstad et al. |
| 2018/0112475 | A1* | 4/2018 | Scekic ..... F16H 25/2454 |
| 2019/0203579 | A1 | 7/2019 | Phillips |
| 2019/0226307 | A1 | 7/2019 | Xiao et al. |

OTHER PUBLICATIONS

International Search Report and Written Opinion issued for PCT/US2024/051709 dated Feb. 14, 2025; 12 pgs.

* cited by examiner

ANTI-ROTATION DEVICE FOR A ROD ROTATOR OF A RECIPROCATING ROD PUMPING SYSTEM

CROSS-REFERENCE TO RELATED APPLICATION

This application is a non-provisional patent application claiming the benefit of, and priority to, U.S. Provisional Patent Application No. 63/591,399, filed Oct. 18, 2023, which is incorporated by reference herein in its entirety.

FIELD OF THE DISCLOSURE

The present disclosure generally relates to reciprocating rod pumping units, and more particularly to rod rotators of the reciprocating rod pumping units.

BACKGROUND

Wellbores are drilled into a subterranean formation to produce hydrocarbon fluids from a producing portion of the subterranean formation. Reciprocating rod reciprocating pumping systems, also referred to as artificial lift systems, are commonly used to carry hydrocarbon production fluids (e.g., fluids containing liquid and/or gas hydrocarbons) from the subterranean formation, through the wellbore, and to a wellhead located above the surface of the earth. Common reciprocating pumping systems typically include a pumping unit, a rod string, and a downhole pump and operate using alternating upstrokes and downstrokes to generate sufficient pressure to pump the hydrocarbon production fluid from the wellbore to the wellhead.

Reciprocating rod pumping units commonly employ a bridle assembly having a sucker rod rotator disposed along a portion of the rod string and are designed to rotate the rod string with each stroke to evenly distribute wear around the rods and couplings that form the rod string. However, an ineffective sucker rod rotator may not be effective at extending the life of the rod string and may actually compromise the integrity of the components of the rod string and/or the entire pumping unit. Without continually inspecting the sucker rod rotator for signs of damage or inefficiency, it remains difficult to determine if the sucker rod rotator is functioning properly or if the rod string has experienced excessive wear or altogether failure.

When the sucker rod rotator rotates the rod string, the sucker rod rotator may experience a high load of torque caused by friction in the wellbore, which can rotate the sucker rod rotator in the bridle assembly. One solution to control and/or prevent rotation of the sucker rod rotator in the bridle assembly includes affixing a single bar with a U-shaped bolt to the housing of the sucker rod rotator. However, this imparts a lateral loading on the rod rotator and the rod string, which increases the friction of the rod string within the wellbore and may cause damage to and/or failure of the sucker rod rotator and/or the components of the rod string. To extend the life of components and ensure efficient operation of the system, the hydrocarbon production industry continues to demand improvement in sucker rod rotator technology that reduces and/or altogether prevents exacerbated or excessive wear on the sucker rod rotator, the components, of the rod string, and/or other components of the pumping system.

SUMMARY

Disclosed is a pumping system, including: a surface unit; a bridle assembly operably coupled to the surface unit; a polished rod extending vertically through a center of the bridle assembly between a first side of the bridle assembly and a second side of the bridle assembly; a rod rotator connected to the polished rod at a location on the polished rod that is above the center of the bridle assembly; and an anti-rotation device mounted to the rod rotator, wherein the anti-rotation device is configured to balance a first force on the first side of the bridle assembly with a second force on the second side of the bridle assembly, such that no side load is imparted onto the rod rotator during operation of the pumping system.

Also disclosed is an anti-rotation device for a rod rotator of a pumping system, including: an arcuate main body portion having a plurality of mounting tabs extending from an inner radiused portion of the arcuate main body portion and configured to mount the arcuate main body portion to the rod rotator; a first laterally extending arm having an end connected to a side of the arcuate main body portion, wherein the first laterally extending arm extends outwardly from the arcuate main body portion in a first direction; and a second laterally extending arm having an end connected to an opposing side of the arcuate main body portion, wherein the second laterally extending arm extends outwardly from the arcuate main body portion in a second direction, and wherein the first direction is opposite of the second direction.

Further disclosed is a method of operating a reciprocating pumping system, including: operating a rod rotator of a pumping system with an anti-rotation device attached to the rod rotator; and balancing, by the anti-rotation device, a first force on a first side of a bridle assembly of with a second force on a second side of the bridle assembly, such that no side load is imparted onto the rod rotator.

Further disclosed is a method of installing an anti-rotation device for a rod rotator of a pumping system, including: attaching an arcuate main body portion of the anti-rotation device to the rod rotator; wherein a first arm of the anti-rotation device has an end connected to a side of the arcuate main body portion and an opposite end extending adjacent to a first side of a bridle assembly; wherein a second arm of the anti-rotation device has an end connected to an opposing side of the arcuate main body portion and an opposite end extending adjacent to a second side of the bridle assembly; and wherein the first arm and the second arm are configured to balance a first force on a first side of a bridle assembly of the pumping system with a second force on a second side of the bridle assembly, such that no side load is imparted onto the rod rotator during operation of the pumping system.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

Disclosed herein is a dual-arm anti-rotation device that reduces the likelihood and/or altogether prevents rotation of the rod rotator for a reciprocating rod pump. Compared to a single-arm anti-rotation device that imparts a lateral load to the rod rotator, and consequently to the polished rod and the rod string of the pump, which increases the friction of the rod string within the wellbore and can damage the one or more pump components, the dual-arm anti-rotation device of this disclosure is configured to create balanced forces on opposite sides of the bridle assembly due to the torque of the rod rotator imparted to the anti-rotation device, when the rod rotator rotates the polished rod. In some aspects, the balancing of the lateral loading forces may keep the rod string more centered within the wellbore and reduce wear on the pump components.

Figure 1:
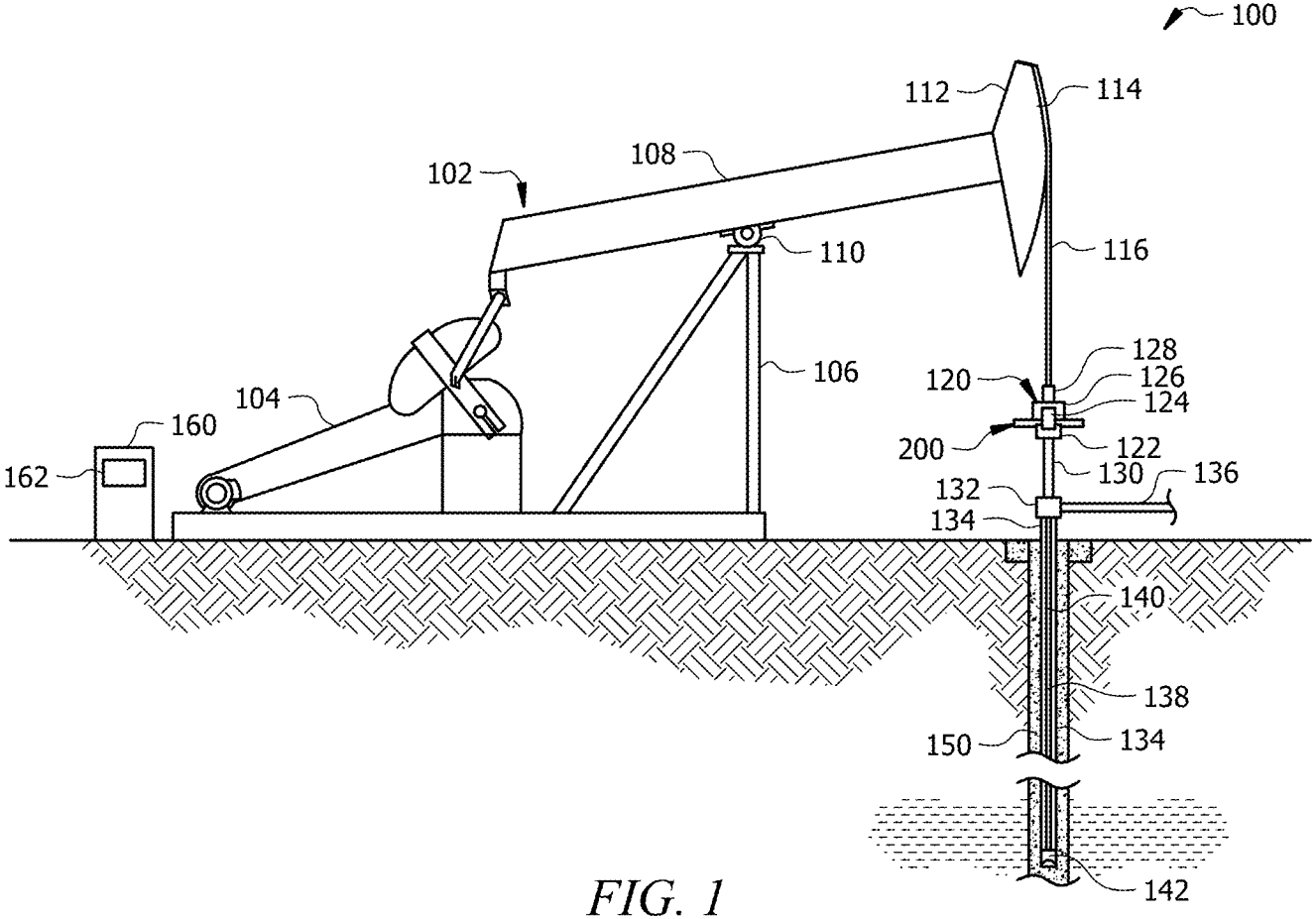
FIG. 1 illustrates a schematic diagram of a reciprocating pumping system.

Referring to FIG. 1, a reciprocating pumping system 100 is shown. The pumping system 100 may generally be configured for producing hydrocarbon fluids from a wellbore 150. In the embodiment shown, the pumping system 100 comprises a long-stroke reciprocating pumping system. However, in some embodiments, the pumping system 100 may comprise a tower-type long-stroke pumping system, or any other suitable pumping system known in the art.

The pumping system 100 may generally comprise a surface unit 102, commonly referred to as a pump jack or a beam pump. The surface unit 102 may comprise a drive unit 104, a support structure 106, and a pivoting or walking beam 108. The walking beam 108 may be elevated above the ground and supported by the support structure 106 at a pivot point 110 about which the walking beam 108 reciprocates during operation. The walking beam 108 may also be coupled to the drive unit 104, such that operation of the drive unit 104 causes the walking beam 108 to reciprocate about the pivot point 110. The walking beam 108 may comprise a horsehead 112 attached at a pumping end of the walking beam 108. To facilitate smooth operation of the surface unit 102, the horsehead 112 may comprise a curved outer surface 114.

The pumping system 100 may also comprise a bridle assembly 120 that may be coupled to the curved outer surface 114 of the horsehead 112 by a set of bridle cables 116 that extend vertically downward from the horsehead 112. The bridle assembly 120 may comprise a carrier bar 122, a set of cable clamps 124, and a rod rotator 126 having one or more polished rod clamps 128. In some embodiments, the bridle assembly 120 may also comprise and/or be coupled to a polished rod 130. Further, as is discussed in greater detail herein, the bridle assembly 120 may also comprise a dual-arm anti-rotation device 200.

In some embodiments, the carrier bar 122 may be coupled to the set of bridle cables 116 extending vertically downward from the horsehead 112 by the pair of cable clamps 124 that are disposed at distal ends of each of the bridle cables 116. The rod rotator 126 may be disposed above the carrier bar 122 and may be coupled to and/or supported by the carrier bar 122. In some embodiments, the polished rod 130 may be disposed at least partially through the rod rotator 126, and the one or more polished rod clamps 128 may be mounted around the portion of the polished rod 130 that extends through the rod rotator 126. In this configuration, the weight of the polished rod 130 may be transferred to the rod rotator 126 and consequently to the bridle assembly 120.

The pumping system 100 may further comprise a wellhead 132 disposed on top of casing or production tubing 134 that may extend from the wellbore 150 and/or be cemented within the wellbore 150. In some embodiments, the wellhead 132 may include components known in the art with the aid of this disclosure, such as a production tree, stuffing box, one or more seals, a blowout preventer (BOP), or any combination thereof. The wellhead 132 may fluidly connect to a hydrocarbon production line 136, through which produced hydrocarbon fluids flows from the wellhead 132 to a storage vessel and/or pipeline.

The polished rod 130 may extend through the wellhead 132 (e.g., via seals to prevent leakage of produced fluid from the wellhead 132) and may be coupled to a drill string or rod string 138 (commonly referred to as a "sucker rod"). In some embodiments, the polished rod 130 and the rod string 138 may be axially aligned along a longitudinal wellbore axis 140 that extends through the wellbore 150. In some embodiments, a lower end of the rod string 138 may be coupled to a plunger or pump 142 that travels upward and downward in the production tubing 134 with the polished rod 130 and the rod string 138 caused by reciprocation of the walking beam 108, which draws hydrocarbon fluids (e.g., oil, gas, etc.) into the production tubing 134, towards the earth's surface, and into the hydrocarbon production line 136.

In some embodiments, the pumping system 100 may comprise a control system 160 configured for controlling the mechanical equipment in the pumping system 100. In some embodiments, the control system 160 may comprise a control interface 162 that may include one or more processors, memory, and instructions stored on the memory that cause the one or more processors to receive signals from one or more sensors associated with operation of the components of the pumping system 100. In some embodiments, the control system 160 may be networked with sensors disposed in the pumping system 100 for control of the hydraulics of the pumping system 100 and/or its individual components via wireless or wired data transmission networking (e.g., Wi-Fi, Bluetooth, NFC, ethernet cables, or combinations thereof). In some embodiments, the pumping system 100 may comprise a load sensor between the bridle assembly 120 and the polished rod 130 and configured to continuously monitor and report values indicating one or more operating parameters (e.g., rotational speed, rotational force, tension, etc.) of the rod string 138 to the control interface 162 and/or the control system 160.

During operation of the pumping system 100, the drive unit may operate to cause reciprocation of the walking beam 108 about the pivot point 110, which causes the horsehead 112 to reciprocate vertically. The vertical reciprocation of the horsehead 112 moves the bridle assembly 120 vertically upward and downward, which also moves the polished rod 130, the rod string 138, and the plunger or pump 142 upward and downward in the production tubing 134. Generated pressure draws hydrocarbon fluids into the production tubing 134, which is then produced through the hydrocarbon production line 136.

Figure 2:
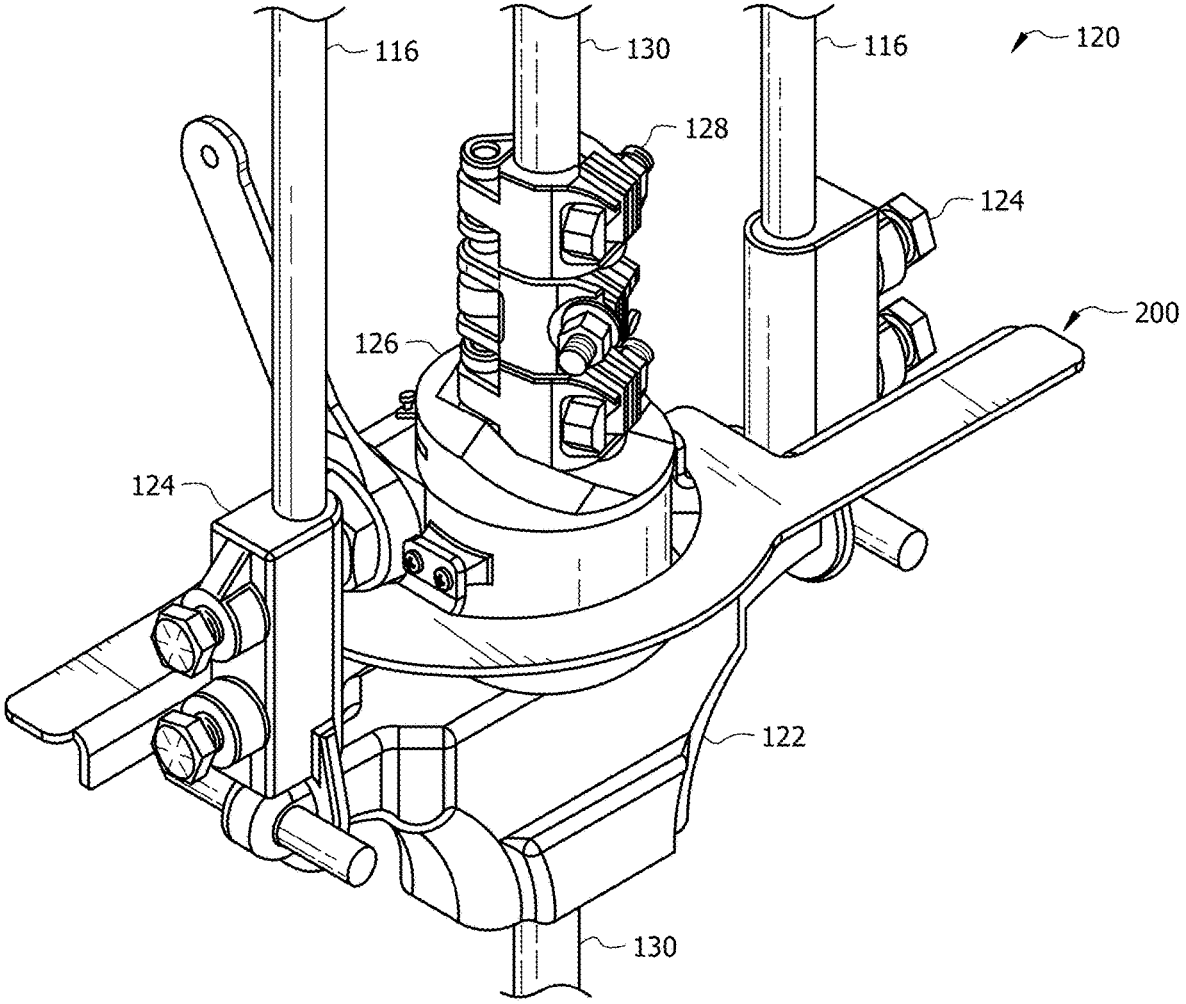
FIG. 2 illustrates an oblique view of a bridle assembly that includes the dual-arm anti-rotation device of this disclosure.
Figure 3:
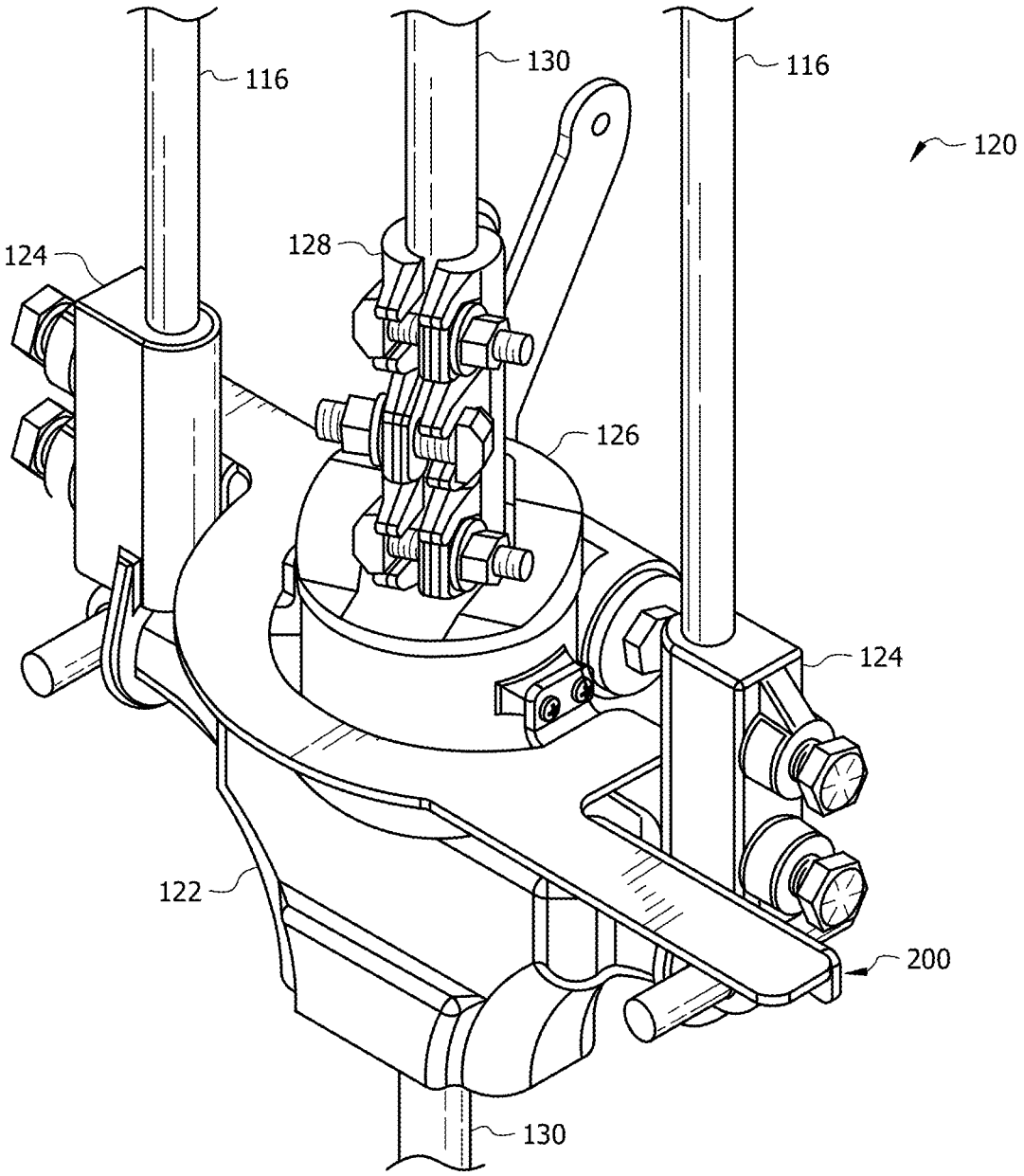
FIG. 3 illustrates another oblique view of the bridle assembly that includes the dual-arm anti-rotation device of this disclosure.
Figure 4:
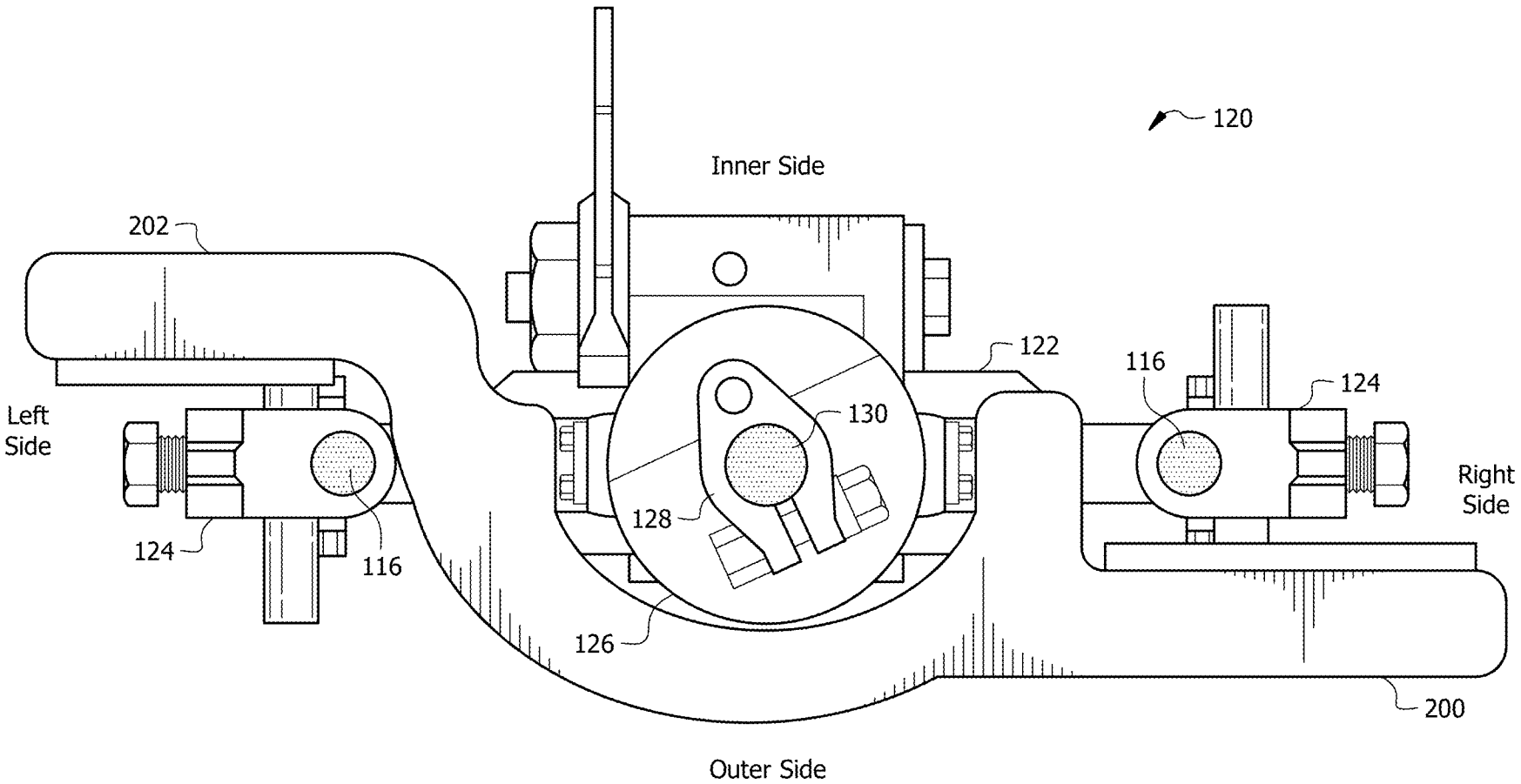
FIG. 4 illustrates an orthogonal top view of the bridle assembly that includes the dual-arm anti-rotation device of this disclosure.

Referring to FIGS. 2-4, oblique views and a top view of the bridle assembly 120 are shown. As stated, the bridle assembly 120 may generally be carried by the set of bridle cables 116 that are affixed to and move with the horsehead 112 of the surface unit 102. The set of bridle cables 116 may comprise two, spaced-apart lifting cables that are coupled to the carrier bar 122 of the bridle assembly 120 by the cable clamps 124 disposed on and coupled to opposing left and right sides of the carrier bar 122. The rod rotator 126 may be disposed above the carrier bar 122 and may be coupled to and/or supported by the carrier bar 122. The polished rod 130 may extend through the carrier bar 122 and the rod rotator 126 and may be secured to the rod rotator 126 by the one or more polished rod clamps 128. In this configuration, the weight of the polished rod 130 and/or the rod string 138 may be transferred to the bridle assembly 120 and enable the rod rotator 126 to selectively rotate the polished rod 130 and the rod string 138 within the wellbore 150.

During operation of the pumping system 100, the rod rotator 126 may selectively rotate the polished rod 130, which also causes the rod string 138 to rotate, during or after each vertical reciprocation of the walking beam 108 and/or the horsehead 112. This is performed to evenly distribute the wear experienced by the components (e.g., rods, couplings, etc.) of the rod string 138, as opposed to localizing the wear to one side of the rod string 138. When the rod rotator 126 rotates the polished rod 130, the rod rotator 126 may experience a high load of torque caused by friction in the wellbore 150, which can rotate the rod rotator 126 in the bridle assembly 120.

However, the bridle assembly 120 comprises the dual-arm anti-rotation device 200 that reduces the likelihood and/or altogether prevents rotation of the rod rotator 126 in the bridle assembly 120. Further, as compared to a single-arm anti-rotation device that imparts a lateral load to the rod rotator 126, and consequently to the polished rod 130 and the rod string 138, which increases the friction of the rod string 138 within the wellbore 150 and can damage the rod rotator 126, the polished rod 130, the rod string 138, and/or other components, the dual-arm anti-rotation device 200 is configured to create balanced lateral forces on opposite sides of the bridle assembly 120 due to the torque of the rod rotator 126 that is imparted to the anti-rotation device 200, when the rod rotator 126 rotates the polished rod 130. In some embodiments, the balancing of the lateral loading forces may keep the rod string 138 more centered within the wellbore 150 and reduce wear on the rod rotator 126, the polished rod 130, the rod string 138, and/or other components. Accordingly, in some embodiments, the anti-rotation device 200 may reduce wear on the rod rotator 126, the polished rod 130, the rod string 138, and/or other components by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater and extend the life of the tool by a comparable amount.

Figure 5:
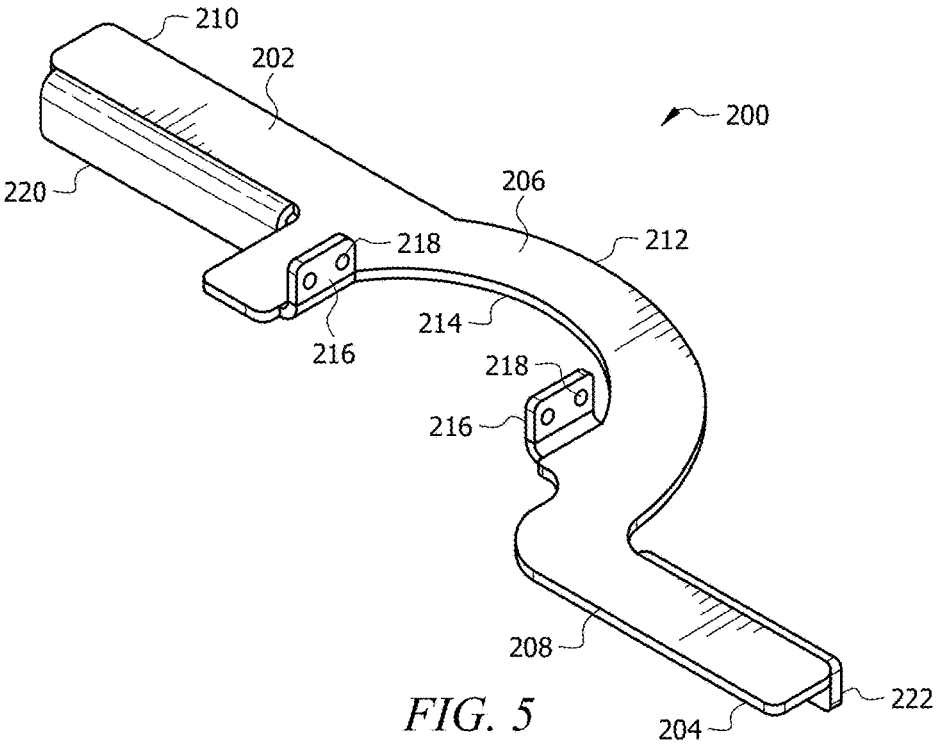
FIG. 5 illustrates an oblique view of a dual-arm anti-rotation device for a rod rotator of a reciprocating pumping system.
Figure 6:
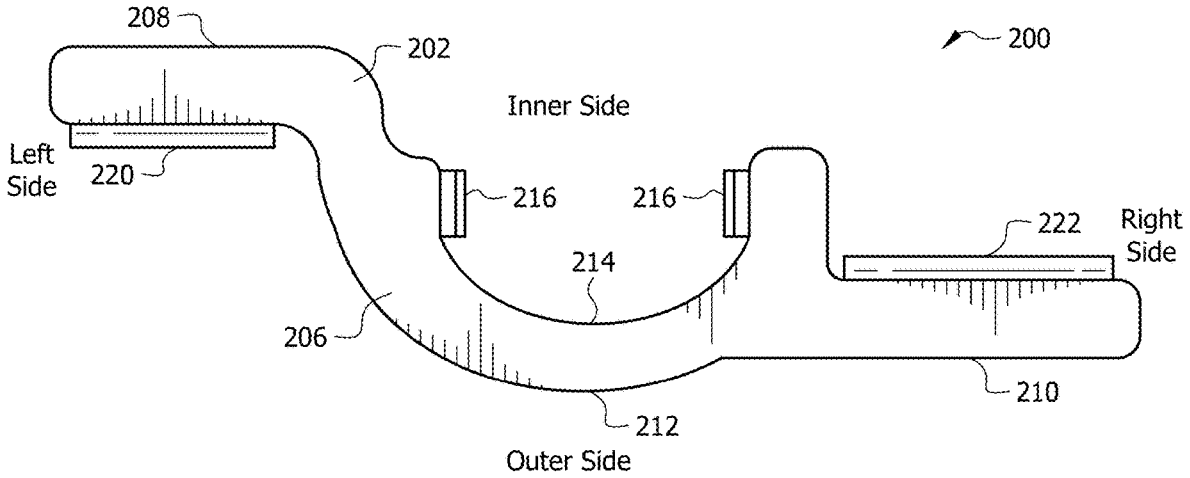
FIG. 6 illustrates a top view of the dual-arm anti-rotation device.

Referring to FIGS. 5 and 6, an oblique view and a top view of the dual-arm anti-rotation device 200 is shown. In some embodiments, the anti-rotation device 200 may be formed from a plate metal, such as carbon steel, stainless steel, or titanium and comprise a top side 202 and a bottom side 204. The anti-rotation device 200 may be formed via machining, laser or waterjet cutting, press braking, stamping, welding, additive manufacturing, casting, or any suitable combination thereof.

The anti-rotation device 200 may generally comprise an arcuate main body portion 206, a first laterally extending arm 208 extending from the arcuate main body portion 206, and second laterally extending arm 210 extending from the arcuate main body portion 206 in an opposing direction from the first laterally extending arm 208. The arcuate main body portion 206 may comprise an outer radiused portion 212, an inner radiused portion 214 that provides clearance to encompass the rod rotator 126, and opposing left and right mounting tabs 216 extending substantially orthogonally from the inner radiused portion 214 and towards the top side 202 of the anti-rotation device 200. The left and right mounting tabs 216 may generally comprise one or more mounting holes 218 disposed through each tab 216 and be configured to receive fasteners therethrough to mount the anti-rotation device 200 to the rod rotator 126 as shown in FIGS. 2-4.

The first laterally extending arm 208 may generally extend laterally (substantially left direction with respect to the bridle assembly 120) from the arcuate main body portion 206. In some embodiments, the first laterally extending arm 208 may be configured to be disposed on an inner side of the respective left-side bridle cable 116 and/or cable clamp 124. In some embodiments, the first laterally extending arm 208 may comprise a first bumper portion 220 configured to interact with the left side cable clamp 124 of the bridle assembly 120 to prevent rotation of the rod rotator 126 when the rod rotator 126 is operated to rotate the polished rod 130. In some embodiments, the first bumper portion 220 may be bent downward towards the bottom side 204 of the anti-rotation device 200. However, in other embodiments, the first bumper portion 220 may be bent upwards towards a top side 202 of the anti-rotation device 200.

The second laterally extending arm 210 may generally extend laterally (substantially right direction with respect to the bridle assembly 120) from the arcuate main body portion 206. In some embodiments, the second laterally extending arm 210 may be configured to be disposed on an outer side of the respective right side bridle cable 116 and/or cable clamp 124. In some embodiments, the second laterally extending arm 210 may comprise a second bumper portion 222 configured to interact with the right-side cable clamp 124 of the bridle assembly 120 to prevent rotation of the rod rotator 126 when the rod rotator 126 is operated to rotate the polished rod 130. In some embodiments, the second bumper portion 222 may be bent downward towards the bottom side 204 of the anti-rotation device 200. However, in other embodiments, the second bumper portion 222 may be bent upwards towards a top side 202 of the anti-rotation device 200.

The first laterally extending arm 208 and the second laterally extending arm 210 may generally extend in opposing directions and extend substantially 180 degrees apart with respect to the rod rotator 126. In some embodiments, each of the first laterally extending arm 208 and the second laterally extending arm 210 may not extend tangentially from the arcuate main body portion 206. In some embodiments, the first laterally extending arm 208 and the second laterally extending arm 210 may not be aligned laterally. This configuration ensures that first laterally extending arm 208 is disposed on an inner side of the respective left-side bridle cable 116, and the second laterally extending arm 210 is disposed on an outer side of the respective right-side bridle cable 116. In some embodiments, the first laterally extending arm 208 and the second laterally extending arm 210 may comprise equal lengths. In other embodiments, the first laterally extending arm 208 and the second laterally extending arm 210 may comprise different lengths.

With the first laterally extending arm 208 disposed on the inner side of the respective left-side bridle cable 116 and the second laterally extending arm disposed on an outer side of the respective right-side bridle cable 116, this configuration allows the first laterally extending arm 208 and the second laterally extending arm 210 to cooperate to counteract reactionary torques acting on the rod rotator 126 that are caused by downhole friction when the rod rotator 126 rotates the polished rod 130. The opposing first laterally extending arm 208 and second laterally extending arm 210 cooperate to evenly distribute reactionary torques about the bridle assembly 120, which drastically reduces or altogether eliminates lateral loading that is common with single-arm anti-rotation devices. By eliminating the lateral loading, the rod string 138 may remain centered within the wellbore 150, drastically reducing downhole friction, which can reduce wear or damage to downhole components and eliminate the likelihood of damage to the rod rotator 126 or other bridle assembly 120 components when the rod rotator 126 is operated to rotate the polished rod 130. Accordingly, in some embodiments, the anti-rotation device 200 may reduce wear on the rod rotator 126, the polished rod 130, the rod string 138, and/or other components by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater and extend the life of the tool by a comparable amount.

Figure 7:
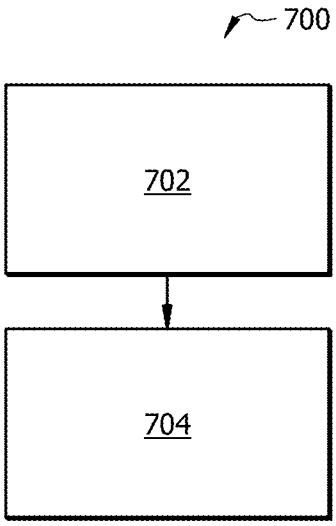
FIG. 7 illustrates a flowchart of a method of installing an anti-rotation device for a rod rotator of a reciprocating pumping system.

Referring to FIG. 7, a flowchart of a method 700 of installing an anti-rotation device 200 for a rod rotator 126 of a reciprocating pumping system 100 is shown. The method 700 may begin at block 702 by providing a dual-arm anti-rotation device 200. The method 700 may continue at block 704 by attaching the anti-rotation device to a rod rotator 126 of a bridle assembly 120. In some embodiments, this may be accomplished by affixing the anti-rotation device 200 to the rod rotator 126 by disposing fasteners through opposing mounting tabs 216 on the anti-rotation device 200 and securing the fasteners to the rod rotator 126. In some embodiments, the method 700 may comprise disposing a first laterally extending arm 208 on an inner side of a respective left-side bridle cable 116 or cable clamp 124, and disposing a second laterally extending arm 210 on an outer side of a respective right-side bridle cable 116 or cable clamp 124. In some embodiments, the anti-rotation device 200 may be configured to balance a first force on a first side of the bridle assembly 120 with a second force on a second side of the bridle assembly 120, such that no lateral or side load is imparted onto the rod rotator 126 during operation of the pumping system 100.

Figure 8:
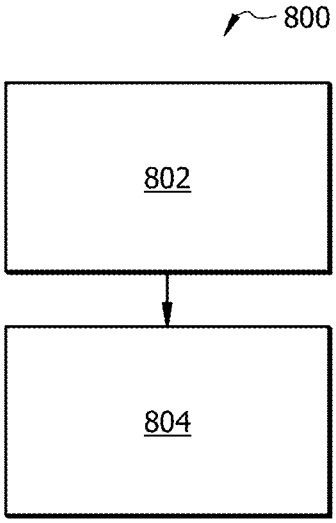
FIG. 8 illustrates a flowchart of a method of operating a reciprocating pumping system.

Referring to FIG. 8, a flowchart of a method 800 of operating a reciprocating pumping system 100 is shown. The method 800 may begin at block 802 by operating a rod rotator 126 of a bridle assembly 120 of a pumping system 100 with a dual-arm anti-rotation device 200 affixed to the rod rotator 126. The method 800 may continue at block 804 by balancing, with the anti-rotation device 200, a first force on a first side of the bridle assembly 120 with a second force on a second side of the bridle assembly 120, such that no lateral or side load is imparted onto the rod rotator 126 during operation of the pumping system 100.

Figure 9:
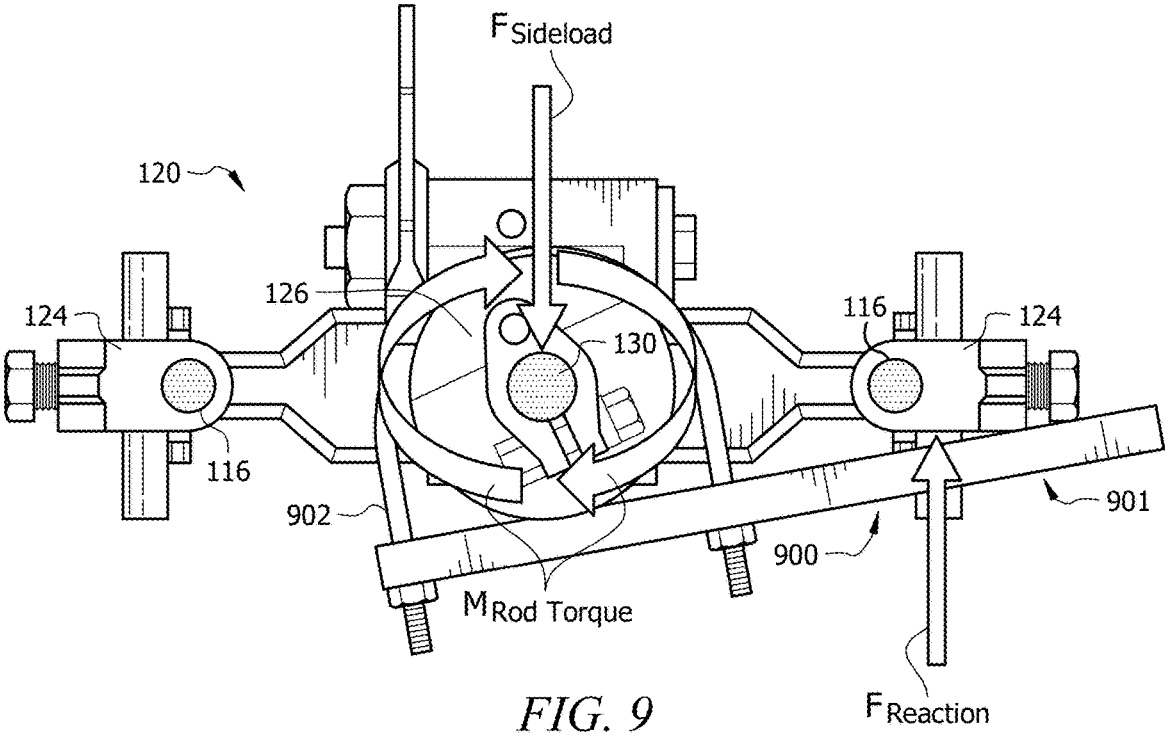
FIG. 9 illustrates an orthogonal top view of a bridle assembly that includes a single-arm anti-rotation device.

FIG. 9 illustrates an orthogonal top view of a bridle assembly 120 that includes a single-arm anti-rotation device 900. The single-arm anti-rotation device 900 includes a single arm 901 with a U-shaped bolt 902 attached to the rod rotator 126 and to the arm 901. The load of the torque of the rod rotator 126 is imparted on the single arm 901. The single arm 901 pushes against only one side of the bridle assembly 120 with force Freaction, creating the side load (Fsideload). The side load (Fsideload) is shown that results from the Freaction applied by the single arm 901 on the side of the bridle assembly. The side load can push the polished rod 130 laterally, which causes stress on the polished rod 130 and associated components of the pumping system.

Figure 10:
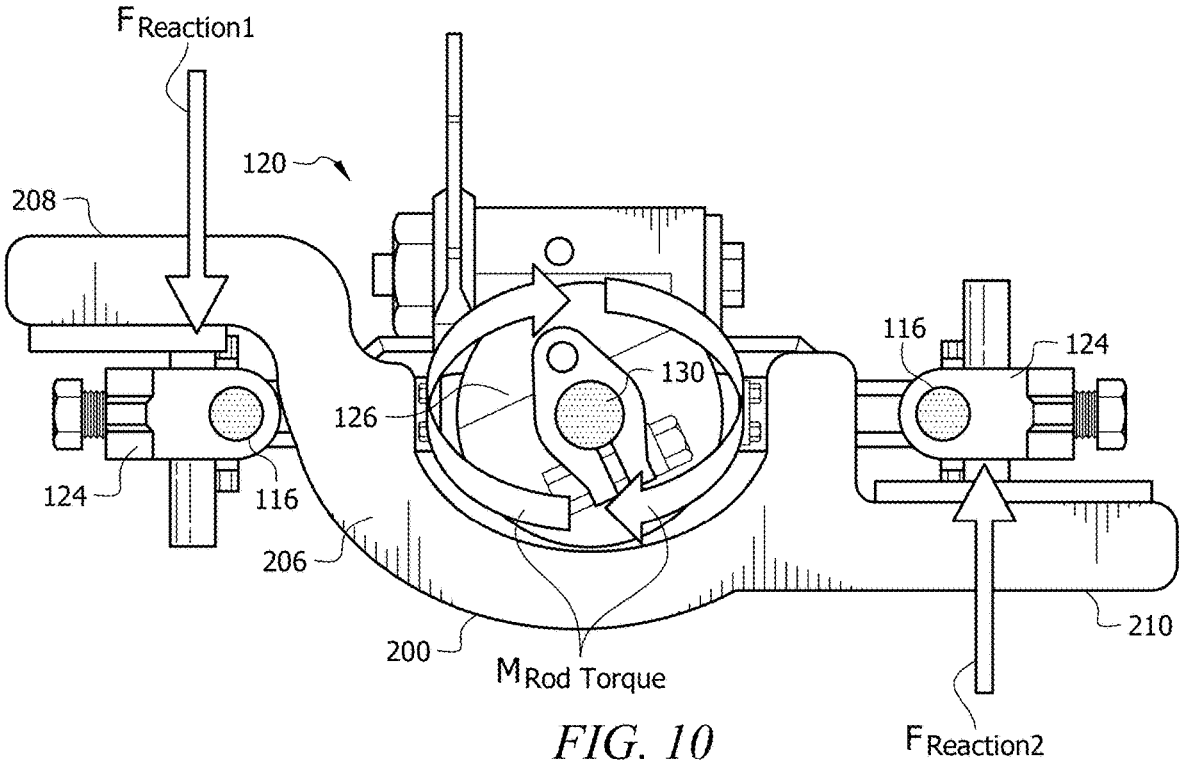
FIG. 10 illustrates an orthogonal top view of the bridle assembly that includes the dual-arm anti-rotation device of this disclosure.

FIG. 10 illustrates an orthogonal top view of the bridle assembly 120 that includes the dual-arm anti-rotation device 200 of this disclosure. In FIG. 10, the load of the torque of the rod rotator 126 is imparted on the arm 208 and on the arm 210. First arm 208 pushes against the side of the bridle assembly 120 with force Freaction1 (which is half the load of the torque), and the second arm 210 pushes against the opposite side of the bridle assembly 120 with force Freaction2 (which is half the load of the torque). The direction of Freaction1 is opposite the direction of Freaction2 due to how the first arm 208 engages the side of the bridle assembly 120 on an inner side of the bridle assembly 120 and how the second arm 210 engages the opposite side of the bridle assembly 120 on an outer side of the bridle assembly 120. The first force (Freaction1) on the first side and inner side of the bridle assembly 120 balances the second force (Freaction2) on the second side and outer side of the bridle assembly 120, such that no side load is imparted onto the rod rotator 126 during operation of the pumping system. The polished rod 130 experiences no side load because no side load is imparted onto the rod rotator 126 during operation of the pumping system.

An advantage of the anti-rotation device 200 in FIG. 10 (and disclosed herein) is that the forces imparted on the sides of the bridle assembly 120 by the arms 208 and 210 are each half of the total torque of the rod rotator 126; whereas, in FIG. 9, the force imparted on the side of the bridle assembly 120 is equal to the total torque. Thus, the anti-rotation device 200 improves wear on the bridle assembly 120 by reducing the force against a given location (side or opposite side) compared to a single arm anti-rotation device.

It will be appreciated that a pumping system 100, a bridle assembly 120, an anti-rotation device 200, a method 700, or a method 800 disclosed herein may comprise one or more of the following embodiments:

Embodiment 1. A pumping system, comprising: a surface unit; a bridle assembly operably coupled to the surface unit; a polished rod extending vertically through a center of the bridle assembly between a first side of the bridle assembly and a second side of the bridle assembly; a rod rotator connected to the polished rod at a location on the polished rod that is above the center of the bridle assembly; and an anti-rotation device mounted to the rod rotator, wherein the anti-rotation device is configured to balance a first force on the first side of the bridle assembly with a second force on the second side of the bridle assembly, such that no side load is imparted onto the rod rotator during operation of the pumping system.

Embodiment 2. The pumping system of embodiment 1, wherein the anti-rotation device comprises: an arcuate main body portion mounted to the rod rotator; a first laterally extending arm having an end connected to a side of the arcuate main body portion and an opposite end extending adjacent to the first side of the bridle assembly; and a second laterally extending arm having an end connected to an opposing side of the arcuate main body portion and an opposite end extending adjacent to the second side of the bridle assembly; wherein the first laterally extending arm and the second laterally extending arm are configured to balance a first force on the first side of the bridle assembly with a second force on the second side of the bridle assembly, such that no side load is imparted onto the rod rotator during operation of the pumping system.

Embodiment 3. The pumping system of embodiment 2, wherein the arcuate main body portion comprises an outer radiused portion and an inner radiused portion, wherein the inner radiused portion provides clearance to encompass the rod rotator.

Embodiment 4. The pumping system of embodiment 3, wherein the inner radiused portion comprises opposing left and right mounting tabs extending orthogonally from the inner radiused portion and towards a top side of the anti-rotation device, and wherein the opposing left and right mounting tabs are configured to mount the anti-rotation device to the rod rotator.

Embodiment 5. The pumping system of embodiment 2, wherein the first laterally extending arm is disposed on an inner side of a respective left-side bridle cable of the pumping system, and wherein the second laterally extending arm is disposed on an outer side of a respective right side bridle cable of the pumping system.

Embodiment 6. The pumping system of embodiment 5, wherein each of the first laterally extending arm and the second laterally extending arm comprise a bumper portion configured to interact with their respective bridle cable to balance the first force with the second force, such that no side load is imparted onto the rod rotator during operation of the pumping system.

Embodiment 7. The pumping system of embodiment 6, wherein the first laterally extending arm and the second laterally extending arm extend in opposing directions and extend substantially 180 degrees apart with respect to the rod rotator.

Embodiment 8. The pumping system of embodiment 7, wherein the first laterally extending arm and the second laterally extending arm are misaligned laterally.

Embodiment 9. The pumping system of embodiment 1, wherein the anti-rotation device reduces wear on the rod rotator, the polished rod, a rod string of the pumping system, or a combination thereof by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater.

Embodiment 10. An anti-rotation device for a rod rotator of a pumping system, comprising: an arcuate main body portion having a plurality of mounting tabs extending from an inner radiused portion of the arcuate main body portion and configured to mount the arcuate main body portion to the rod rotator; a first laterally extending arm having an end connected to a side of the arcuate main body portion, wherein the first laterally extending arm extends outwardly from the arcuate main body portion in a first direction; and a second laterally extending arm having an end connected to an opposing side of the arcuate main body portion, wherein the second laterally extending arm extends outwardly from the arcuate main body portion in a second direction, and wherein the first direction is opposite of the second direction.

Embodiment 11. The anti-rotation device of embodiment 10, wherein the arcuate main body portion comprises an outer radiused portion and an inner radiused portion, wherein the inner radiused portion provides clearance to encompass the rod rotator.

Embodiment 12. The anti-rotation device of embodiment 11, wherein the inner radiused portion comprises opposing left and right mounting tabs extending orthogonally from the inner radiused portion and towards a top side of the anti-rotation device, and wherein the opposing left and right mounting tabs are configured to mount the anti-rotation device to the rod rotator.

Embodiment 13. The anti-rotation device of embodiment 10, wherein the first laterally extending arm is disposed on an inner side of a respective left-side bridle cable of the pumping system, and wherein the second laterally extending arm is disposed on an outer side of a respective right side bridle cable of the pumping system.

Embodiment 14. The anti-rotation device of embodiment 13, wherein each of the first laterally extending arm and the second laterally extending arm comprise a bumper portion configured to interact with their respective bridle cable to balance forces acting on the rod rotator, such that no side load is imparted onto the rod rotator during operation of the pumping system.

Embodiment 15. The anti-rotation device of embodiment 14, wherein the first laterally extending arm and the second laterally extending arm extend in opposing directions and extend substantially 180 degrees apart with respect to the rod rotator.

Embodiment 16. The anti-rotation device of embodiment 15, wherein the first laterally extending arm and the second laterally extending arm are misaligned laterally.

Embodiment 17. The anti-rotation device of embodiment 10, wherein the anti-rotation device reduces wear on the rod rotator, a polished rod, a rod string of the pumping system, or a combination thereof by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater.

Embodiment 18. A method of operating a reciprocating pumping system, comprising: operating a rod rotator of a pumping system with an anti-rotation device attached to the rod rotator; and balancing, by the anti-rotation device, a first force on a first side of a bridle assembly of with a second force on a second side of the bridle assembly, such that no side load is imparted onto the rod rotator.

Embodiment 19. The method of embodiment 18, wherein the anti-rotation device comprises: an arcuate main body portion mounted to the rod rotator; a first laterally extending arm having an end connected to a side of the arcuate main body portion and an opposite end extending adjacent to a first side of the bridle assembly; and a second laterally extending arm having an end connected to an opposing side of the arcuate main body portion and an opposite end extending adjacent to a second side of the bridle assembly; wherein the first laterally extending arm and the second laterally extending arm are configured to balance a first force on the first side of the bridle assembly with a second force on the second side of the bridle assembly, such that no side load is imparted onto the rod rotator during operation of the pumping system.

Embodiment 20. A method of installing an anti-rotation device for a rod rotator of a pumping system, comprising: attaching an arcuate main body portion of the anti-rotation device to the rod rotator; wherein a first arm of the anti-rotation device has an end connected to a side of the arcuate main body portion and an opposite end extending adjacent to a first side of a bridle assembly; wherein a second arm of the anti-rotation device has an end connected to an opposing side of the arcuate main body portion and an opposite end extending adjacent to a second side of the bridle assembly; and wherein the first arm and the second arm are configured to balance a first force on a first side of a bridle assembly of the pumping system with a second force on a second side of the bridle assembly, such that no side load is imparted onto the rod rotator during operation of the pumping system.

Although the present disclosure and its advantages have been described in detail, it should be understood that various changes, substitutions, and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A pumping system, comprising:

a surface unit;

a bridle assembly operably coupled to the surface unit;

a polished rod extending vertically through a center of the bridle assembly between a first side of the bridle assembly and a second side of the bridle assembly;

a rod rotator connected to the polished rod at a location on the polished rod that is above the center of the bridle assembly; and an anti-rotation device mounted to the rod rotator, wherein the anti-rotation device comprises:

an arcuate main body portion mounted to the rod rotator;

a first laterally extending arm having an end connected to a side of the arcuate main body portion and an opposite end extending adjacent to the first side of the bridle assembly; and a second laterally extending arm having an end connected to an opposing side of the arcuate main body portion and an opposite end extending adjacent to the second side of the bridle assembly;

wherein:

1) The arcuate main body portion comprises an outer radiused portion and an inner radiused portion, wherein the inner radiused portion comprises opposing left and right mounting tabs extending orthogonally from the inner radiused portion and towards a top side of the anti-rotation device, and wherein the opposing left and right mounting tabs are configured to mount the anti-rotation device to the rod rotator;

or

2) The first laterally extending arm and the second laterally extending arm are misaligned laterally.

2. The pumping system of claim 1, wherein the first laterally extending arm and the second laterally extending arm are configured to balance a first force on the first side of the bridle assembly with a second force on the second side of the bridle assembly, such that no side load is imparted onto the rod rotator during operation of the pumping system.

3. The pumping system of claim 2, wherein the inner radiused portion provides clearance to encompass the rod rotator.

4. The pumping system of claim 2, wherein the first laterally extending arm is disposed on an inner side of a left-side bridle cable of the pumping system, and wherein the second laterally extending arm is disposed on an outer side of a right-side bridle cable of the pumping system.

5. The pumping system of claim 4, wherein the first laterally extending arm comprises a bumper portion configured to interact with the left-side bridle cable and the second laterally extending arm comprises a bumper portion configured to interact with the right-side bridle cable.

6. The pumping system of claim 5, wherein the first laterally extending arm and the second laterally extending arm extend in opposing directions and extend substantially 180 degrees apart with respect to the rod rotator.

7. The pumping system of claim 1, wherein the anti-rotation device reduces wear on the rod rotator, the polished rod, a rod string of the pumping system, or a combination thereof by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater.

8. An anti-rotation device for a rod rotator of a pumping system, comprising:

an arcuate main body portion having a plurality of mounting tabs extending from an inner radiused portion of the arcuate main body portion and configured to mount the arcuate main body portion to the rod rotator;

a first laterally extending arm having an end connected to a side of the arcuate main body portion, wherein the first laterally extending arm extends outwardly from the arcuate main body portion in a first direction; and a second laterally extending arm having an end connected to an opposing side of the arcuate main body portion, wherein the second laterally extending arm extends outwardly from the arcuate main body portion in a second direction, and wherein the first direction is opposite of the second direction;

wherein:

1) the arcuate main body portion comprises an outer radiused portion, wherein the inner radiused portion comprises opposing left and right mounting tabs extending orthogonally from the inner radiused portion and towards a top side of the anti-rotation device, and wherein the opposing left and right mounting tabs are configured to mount the anti-rotation device to the rod rotator;

or 2) the first laterally extending arm and the second laterally extending arm are misaligned laterally.

9. The anti-rotation device of claim 8, wherein the inner radiused portion provides clearance to encompass the rod rotator.

10. The anti-rotation device of claim 8, wherein the first laterally extending arm is disposed on an inner side of a left-side bridle cable of the pumping system, and wherein the second laterally extending arm is disposed on an outer side of a right-side bridle cable of the pumping system.

11. The anti-rotation device of claim 10, wherein the first laterally extending arm comprises a bumper portion configured to interact with the left-side bridle cable and the second laterally extending arm comprises a bumper portion configured to interact with the right-side bridle cable.

12. The anti-rotation device of claim 11, wherein the first laterally extending arm and the second laterally extending arm extend in opposing directions and extend substantially 180 degrees apart with respect to the rod rotator.

13. The anti-rotation device of claim 8, wherein the anti-rotation device reduces wear on the rod rotator, a polished rod of the pumping system, a rod string of the pumping system, or a combination thereof by at least 1%, at least 2%, at least 3%, at least 4%, at least 5%, at least 7.5%, at least 10%, at least 12.5%, at least 15%, at least 20%, at least 25%, at least 30%, at least 40%, at least 50%, or even greater.

14. A method comprising:

attaching the anti-rotation device of claim 8 to the rod rotator of the pumping system; or operating the rod rotator of the pumping system with the anti-rotation device of claim 8 attached to the rod rotator, and balancing, by the anti-rotation device of claim 8, a first force on a first side of a bridle assembly with a second force on a second side of the bridle assembly, such that no side load is imparted onto the rod rotator.

* * * * *